US006626727B2

(12) United States Patent
Balanchi

(10) Patent No.: US 6,626,727 B2
(45) Date of Patent: Sep. 30, 2003

(54) MAGNETIC CONSTRUCTION TOY

(76) Inventor: Steven H. Balanchi, 151 Wonder View Dr., Glendale, CA (US) 91202

( * ) Notice: Subject to any disclaimer, the term of this patent is extended or adjusted under 35 U.S.C. 154(b) by 0 days.

(21) Appl. No.: 10/071,767

(22) Filed: Feb. 6, 2002

(65) Prior Publication Data

US 2003/0148699 A1 Aug. 7, 2003

(51) Int. Cl.[7] ..... A63H 33/04

(52) U.S. Cl. ..... 446/85; 446/92; 446/124; 273/157 R

(58) Field of Search ..... 446/85, 87, 92, 446/119, 102, 107, 122, 124–126, 128, 129, 137, 132; 434/190, 208, 211, 213, 214, 277–279; 273/156, 157 R, 456

(56) References Cited

U.S. PATENT DOCUMENTS 2,846,809 A * 8/1958 Majewski ..... 434/278
2,970,388 A * 2/1961 Yonkers ..... 403/171
3,556,526 A * 1/1971 Currie ..... 273/239
3,606,333 A * 9/1971 Green ..... 273/239
3,625,514 A * 12/1971 Haaland ..... 273/153 J

FOREIGN PATENT DOCUMENTS

GB 2123306 A * 2/1984 ..... A63H/33/26

* cited by examiner

*Primary Examiner*—Derris H. Banks
*Assistant Examiner*—Bena B. Miller
(74) *Attorney, Agent, or Firm*—Frederick Gotha

(57) ABSTRACT

The invention relates to a geometric construction toy for building cubic and square profiles and consists of a multiplicity of like dimensioned magnetizable bodies and interconnecting members. The interconnecting members have an axis of elongation and magnetic ends which magnetize and couple with a respective magnetizable body along a mutually perpendicular axis of the magnetizable body. After coupling, the axis of elongation is axially coincident with one of the mutually perpendicular axis of the magnetizable body and at an angle of 90° to each of the other axes. The magnetic ends of the interconnecting members are tapered for insertion into cylindrical recesses extending axially into the outer surface of the magnetizable body to permit stable magnetic coupling along a mutually perpendicular axis of the magnetizable body.

12 Claims, 4 Drawing Sheets

MAGNETIC CONSTRUCTION TOY

FIELD OF THE INVENTION

This invention relates to a construction toy for building stable geometrical structures of square and cubical shapes utilizing magnetizable bodies and connecting members.

BACKGROUND OF THE INVENTION

Construction toys for two and three dimensional geometrical structures involving magnetic interconnecting members require close tolerances in the manufacture of these members in order to have a stable model. Typically, a magnetic arm member acts as a connector between two spheres which are magnetizable and the arm has concave surfaces at each end for engagement with a respective sphere. A variety of geometrically shaped structures can be constructed and retain stability provided the surfaces of the interacting faces form a close fit. The need for the use of close tolerances is demonstrated in U.S. Pat. No. 2,970,388, which discloses an educational device for building toy crystaline structures with magnetic spheres and interconnecting magnetic bars. The magnetic bars are formed with a concave surface at each end conforming to the surface of an interconnecting sphere and the concave ends are freely moveable over the surface of the sphere. Very close tolerances are required in the dimensions of the sphere in order to construct stable two or three dimensional geometric configurations. It would be advantageous to minimize the requirement of close tolerances and thereby reduce manufacturing costs, and consequently the cost of the magnetic construction toy, and thus provide a toy having interconnecting members capable of creating magnetic couplings resulting in stable geometrical structures.

SUMMARY OF THE INVENTION

There is, therefore, provided according to the present invention, a geometric construction toy for building cubic and square profiles where the need for close tolerances is minimized yet the interconnecting members form a stable structure.

The present invention is directed to a geometric construction toy that consists of a connecting member that has an axis of elongation and is magnetizable at its ends. The ends of the connecting member are magnetically coupled to a magnetizable body having mutually perpendicular vertical, horizontal, and lateral axes that intersect at a common point. The magnetizable body has a peripheral boundary surface which is symetrically disposed and symmetric with respect to each of the 3 mutually intersecting perpendicular planes forming the mutually intersecting axes. A multiplicity of recesses which extend axially into the peripheral boundary surface are so dimensioned and proportioned to receive a magnetizable end of the connecting member and magnetically couples to the magnetizable body to extend axially from the magnetizable body.

In one embodiment of the invention, the magnetizable body is a sphere which consists of an inner spherical magnetizable body surrounded by a spherical, preferably insulative, outer body having a multiplicity of axial extending recesses at least in part contained in the outer spherical body. The recesses are so dimensioned and proportioned to receive the magnetized end of the connecting member so as to permit the connecting member and magnetizable body to couple magnetically. Each recess is ninety degrees (90°) from an adjacent recess which permits the connecting members to extend axially from the magnetizable body with angles of ninety-degrees between the axes of elongation of the connecting members. By the use of multiple like dimensioned and constructed magnetizable bodies and like dimensioned and constucted connecting members, the builder is enabled to construct stable profiles of squares and cubes utilizing members that do not require close tolerances in manufacture.

In another embodiment of this invention, the magnetizable body is a cube which is composed of an inner magnetizable cube surrounded by an outer body, preferabley an insulative body, having a multiplicity of axially extending aperatures contained in the outer body. The aperatures are so dimensioned and proportioned to receive the magnetized end of the connecting member so as to permit the connecting member and cube to magnetically couple. After coupling, the connecting member extends axially from the cube along an axis that is a mutually perpendicular axis where the set of axes have an intersection which is at the geometrical center of the cube. Each recess is therefore ninety-degrees (90°) from an adjacent recess which permits the connecting members to extend axially from the cube with the axes of elongation of the connecting members either at ninety-degrees (90°) or one hundred eighty-degrees (180°) to a coupled connecting member. The connecting members in the embodiments above described have permanent magnets fixedly carried at their ends.

In yet another embodiment of this invention, the magnetizable body is a sphere surrounded by a cubic outer body, preferably an insulative body, having a multiplicity of axially extending aperatures contained in the outer body. The aperatures are so dimensioned and proportioned to receive the magnetized end of the connecting member so as to permit the connecting member and sphere to magnetically couple. After coupling, the connecting member extends axially from the outer body along an axis that is a mutually perpendicular axis where the set of axes have an intersection which is at the geometrical center of the cube. Each recess is therefore ninety-degrees (90°) from an adjacent recess which permits the connecting members to extend axially from the outer body with the axes of elongation of the connecting members either at ninety-degrees or one hundred eighty-degrees (180°) to a coupled connecting member. Preferably, the connecting members in the embodiments above described have permanent magnets fixedly carried at their ends, however, the inner bodies may be permanent magnets and the connecting members magnetizable.

BRIEF DESCRIPTION OF THE DRAWINGS

These and other features and advantages will become appreciated as the same become better understood with reference to the following specification, claims and drawings wherein:

DETAILED DESCRIPTION

Figure 1:
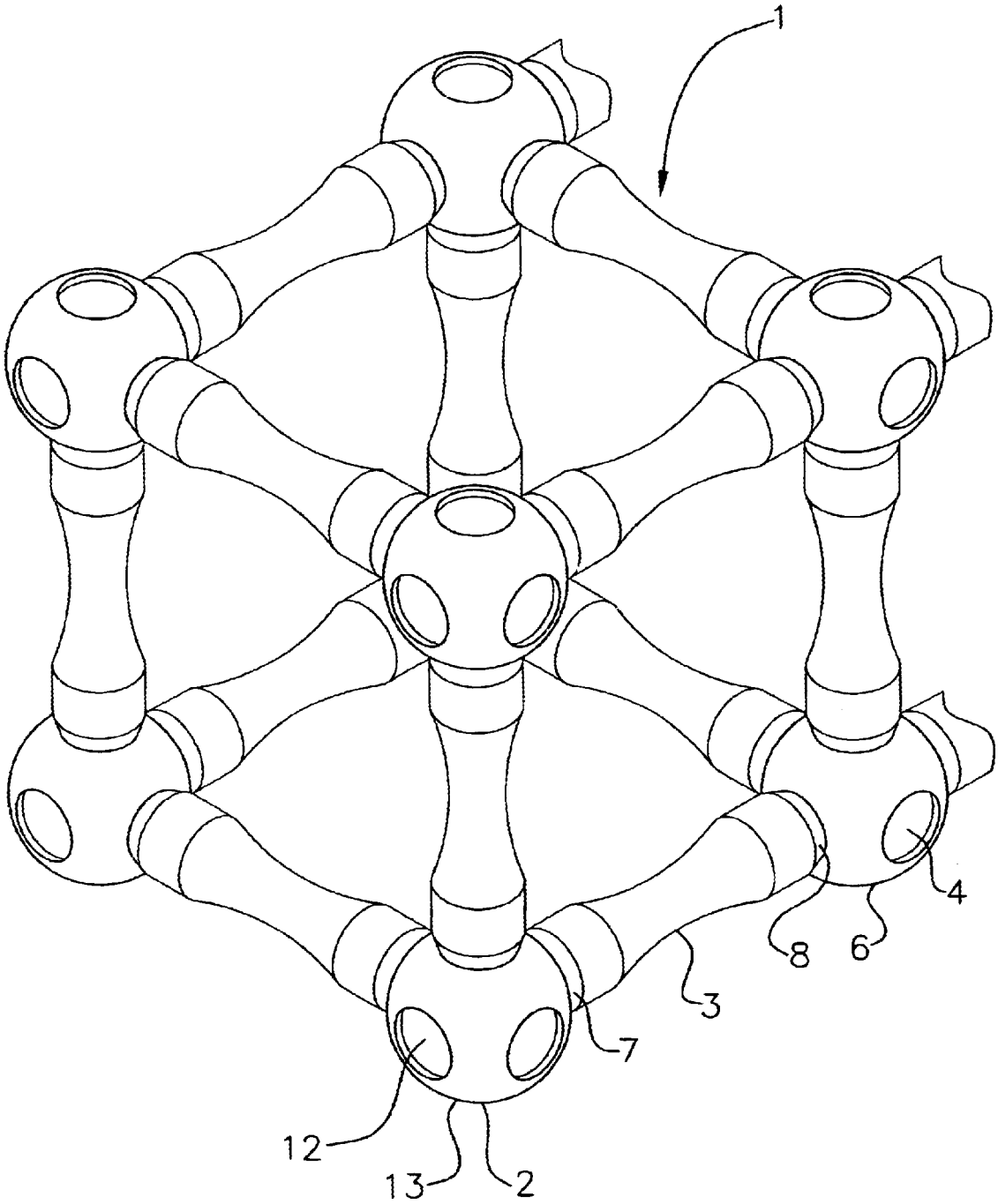
FIG. 1 is a perspective view of a cubic profile of a geometrical toy structure constructed with the magnetizable bodies and interconnecting members of this invention in magnetically coupled relationship.

FIG. 1 is a perspective view of an assembled cubic toy construction 1 utilizing the magnetizable bodies 2 and interconnecting members 3 of this invention. As can be seen in FIG. 1, the toy structure is composed of a multiplicity of identically dimensioned and constructed magnetizable bodies and interconnecting members. Although a linked cube is depicted in FIG. 1, the toy structure may be built upon by further linking cubes to create various geometrical structures. Stability of the geometrical structure is achieved through the recesses 4 contained in the outer surface or peripheral boundary surface 6 of magnetizable body 2 as receptacles for the magnetized first and second ends 7 and 8 of interconnecting member 3. The construction of interconnecting member 3 is more fully illustrated in FIGS. 6 and 7.

Figure 6:
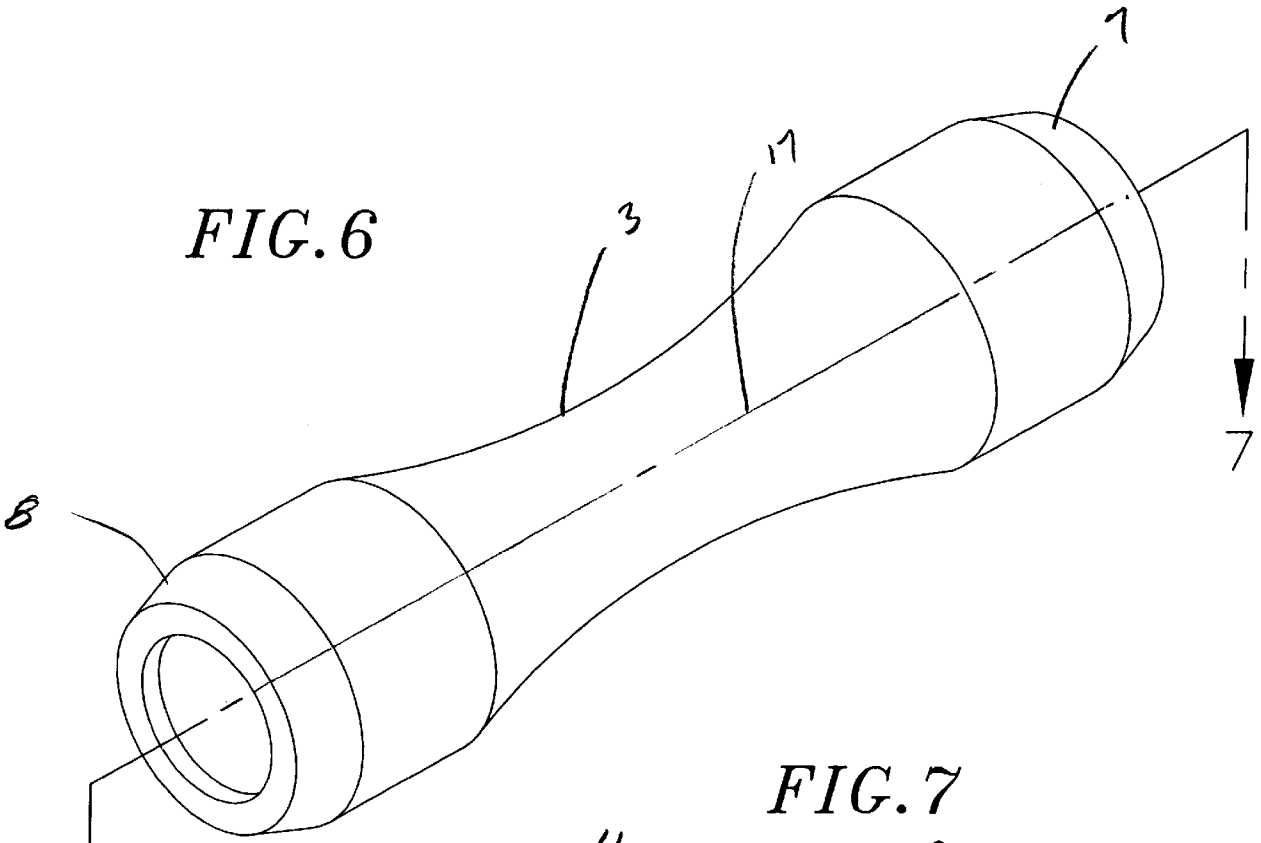
FIG. 6 is a perspective view of the interconnecting member of this invention.
Figure 7:
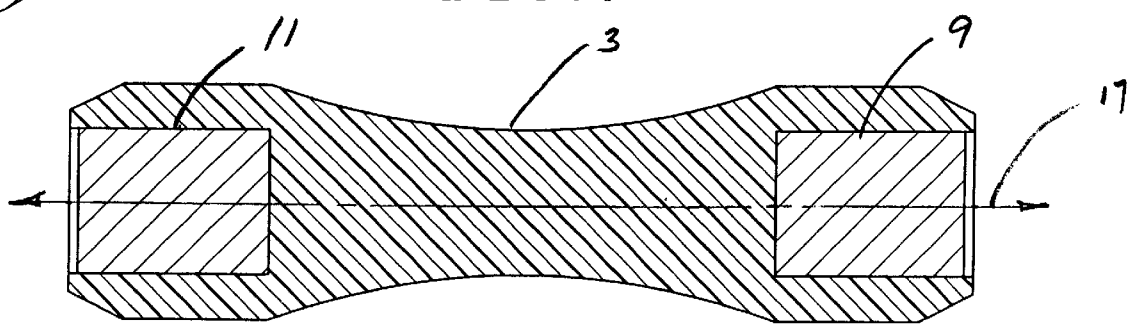
FIG. 7 is a cross-sectional view along the line 7—7 shown in FIG. 6.

By referring to FIG. 6, which is a perspective view of interconnecting member 3, it can be seen that first end 7 and second end 8 are tapered to permit the ends of interconnecting member 3 to couple with a respective recess 4 magnetically without the necessity of permanent magnets 9 and 11, shown in FIG. 7, to have a curvature at the respective ends of the interconnecting member 3 that is equivalent to the curvature of magnetizable body 2.

Figure 2:
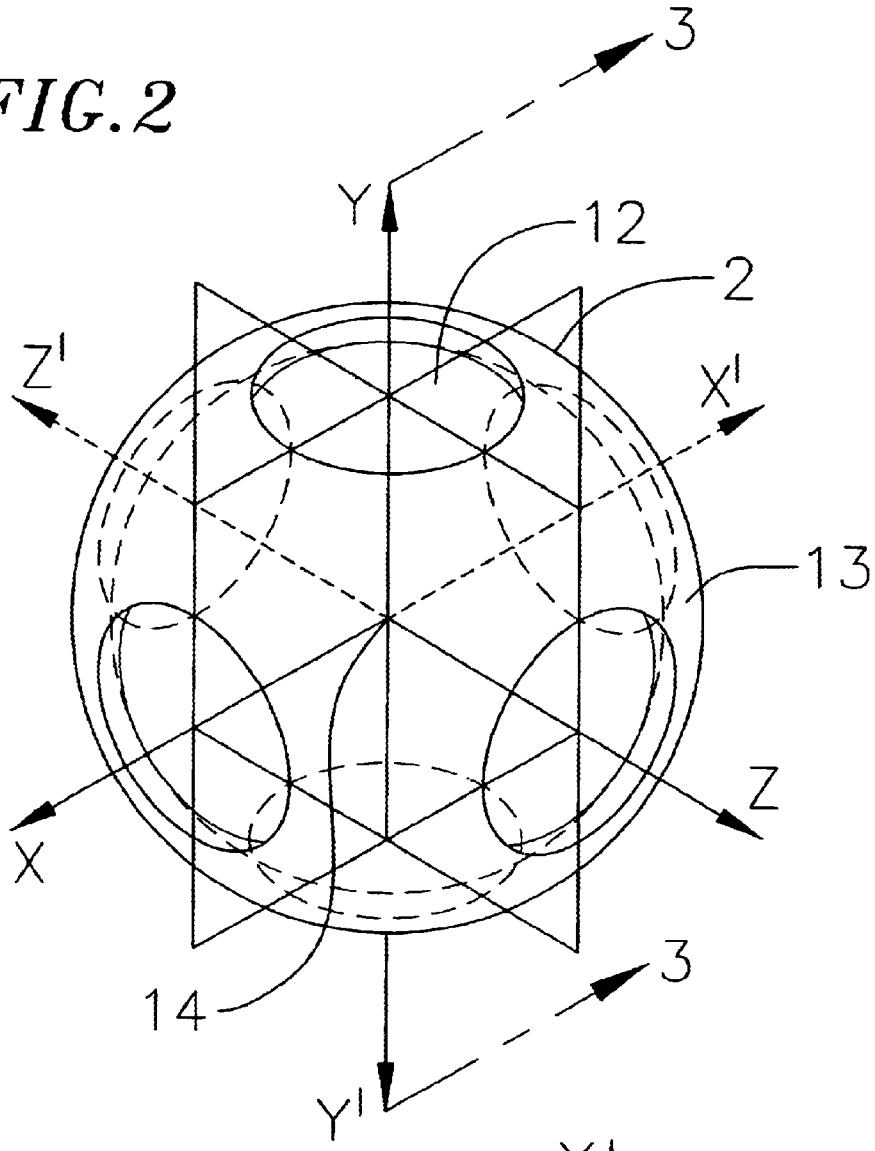
FIG. 2 is a perspective view of an embodiment of this invention illustrating a spherical magnetizable body having axially positioned recesses.
Figure 3:
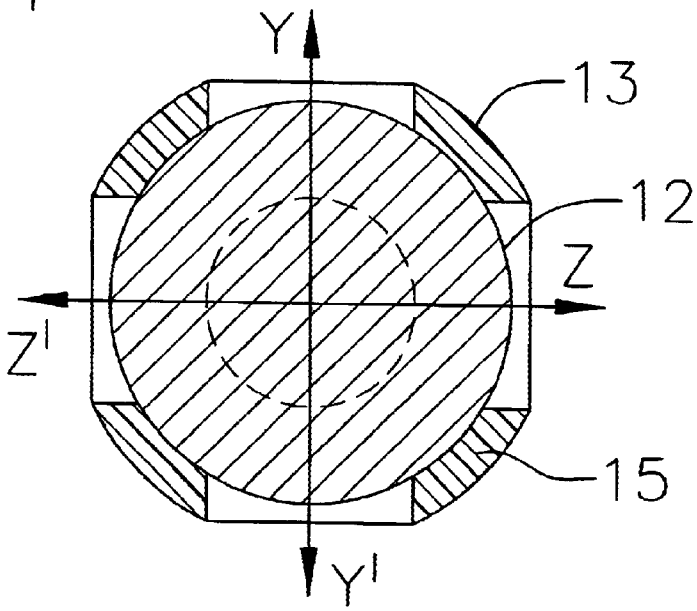
FIG. 3 is a cross-sectional view along the line 3—3 shown in FIG. 2.

Although it is preferred that the first and second ends of interconnecting member 3 be permanent magnets, the ends in another embodiment could consist of magnetizable members that would couple magnetically to a permanent magnet contained in the magnetizable body 2. As can be seen in FIGS. 2 and 3, the magnetizable body 2 has an inner body 12 made of a magnetizable material and an outer body 13 made of insulative material 15. The magnetizable material may be a permanent magnet; however, in the preferred embodiment of this invention, inner body 12 is magnetizable and magnetized by the permanent magnet located adjacent an end of interconnecting member 3.

By referring to FIGS. 2 and 3, it can be seen that magnetizable body 2 has mutually perpendicular axes xx', yy' and zz' formed by the inersection of mutually perpendiclar planes xy, xz, and yz that intersect at the geometrical center 14 of magnetizable body 2. The outer surface or peripheral boundary surface 6 of magnetizable body 2 contains a multiplicity of recesses 4 which are identically dimensioned and proportioned to receive a respective end of interconnecting member 3 such that the axis of elongation 17 of the interconnecting member is co-incident axially with one of the mutually perpendicular axis after magnetically coupling with magnetizable body 2 and approximately at an angle of ninety degrees (90°) to the other mutually perpendicular axes of magnetizable body 2. In the preferred embodiment an outer spherical body 13 surrounds an inner spherical body 12 where the recesses 4 are openings or aperatures extending through outer body 13. In another embodiment of this invention (not shown), the magnetizable body 2 could be a continuous spherical body with recesses located on its boundary surface and recessed therein.

Figure 4:
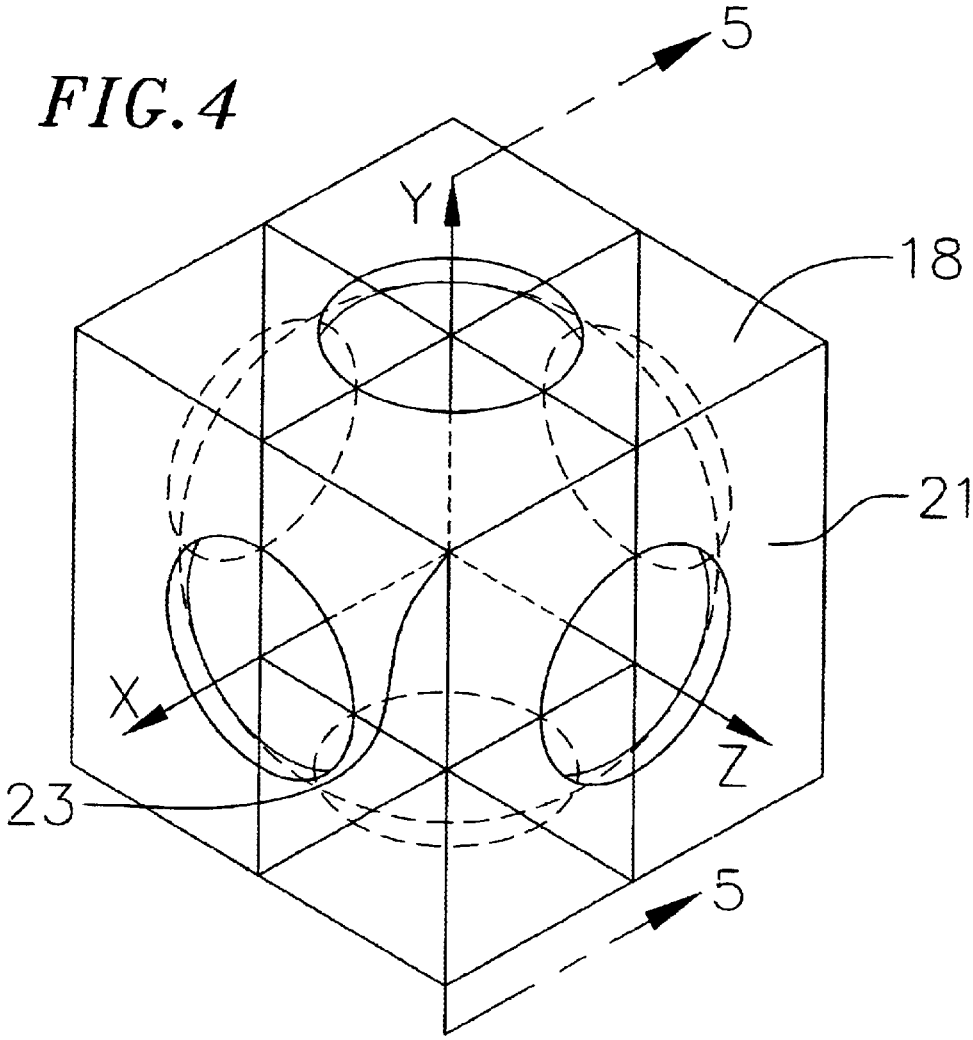
FIG. 4 is a perspective view of an embodiment of this invention illustrating a cubic outer body having a spherical magnetizable body and having axially positioned aperatures in the outer body.
Figure 5:
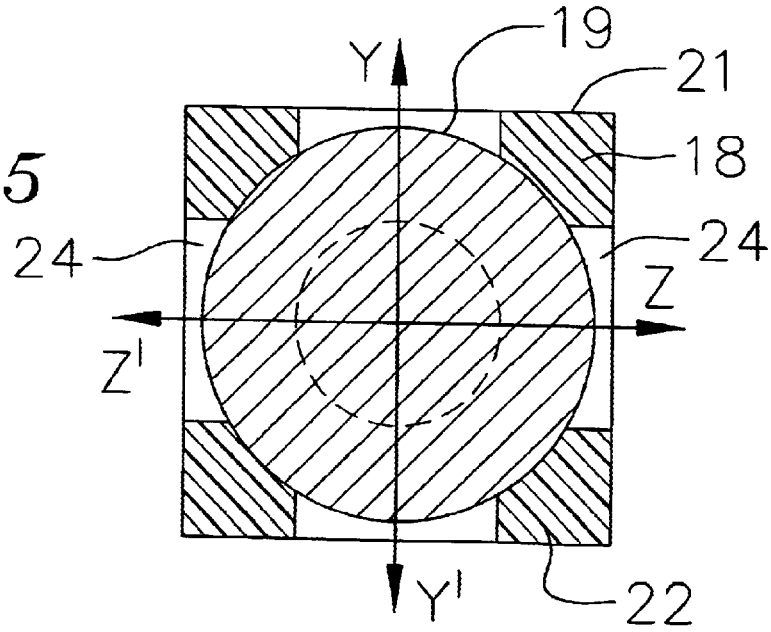
FIG. 5 is a cross-sectional view along the line 5—5 shown in FIG. 4.

Another embodiment of this invention is illustrated in FIGS. 4 and 5. In this embodiment, the outer body 18 is cube-shaped and inner body 19 may be spherically shaped as shown in FIG. 5. Although not shown, the magnetizable body of this invention may be a continuous cubic body having recesses located on its boundary surface and in yet another embodiment the inner body may be other than spherically shaped, i.e., a cube shape and the outer body having the shape of a cube made of an insulative material. As can be seen in FIGS. 4 and 5, the magnetizable body 21 is composed of an inner magnetizable sphere 19 surrounded by a cubic outer body 22 which is preferably made of an insulative material. A set of mutually perpendicular axes, xx', yy' and zz' formed by the intersection of mutually perpendicular planes xy, xz, and yz have a point of intersection 23 at the geometrical center of magnetizable body 21 and each axis passes through a pair of circular recesses 24 having their centers located on the axis. Thus, when an end of interconnecting member 3 magnetically couples with magnetizable body 21, the elongation axis 17 of the interconnecting member will be axially coincident with a respective mutually perpendicular axis and at (90°) degrees to the remaining axes.

By referring to FIG. 1, an assembled geometrical cubic profile of magnetic construction elements utilizing the interconnecting members and magnetizable bodies of this invention can be seen. While I have shown and described embodiments of a magnetic construction toy, it is to be understood that the invention is subject to many modifications without departing from the scope and spirit of the claims as recited herein.

What is claimed is:

1. A geometric construction toy, comprising:

(a) a cylindrically shaped connecting member having a first end, a second end, and an axis of elongation, where said cylindrically shaped connecting member is radially symmetrical with respect to said axis of elongation, and a first magnet captively carried within said cylindrically shaped connecting member adjacent said first end;

(b) a magnetizable body having mutually perpendicular vertical, horizontal, and lateral axes formed by the intersection of three mutually perpendicular planes, said axes having an origin point of common intersection within said magnetizable body, where said origin point of common intersection is at the geometrical center of said magnitizable body, and where said magnetizable body has a peripheral boundary surface symmetrical with respect to each said mutually perpendicular plane, said peripheral boundary surface having a multiplicity of recesses disposed in said periperal boundary surface where each said recess is concentric respectively with one of said axes and so dimensioned and proportioned to receive said first end of said connecting member so as to permit said connecting member to magnetically couple with said magnetizable body.

2. The geometric construction toy recited in claim 1 wherein said cylindrically shaped connecting member further comprises a second magnet captively carried within said connecting member adjacent said second end and where said first end and said second end are tapered.

3. The geometric construction toy recited in claim 2 wherein said multiplicity of recesses are so dimensioned and proportioned to receive either said first end of said cylindrically shaped connecting member or said second end of said cylindrically shaped connecting member so as to permit said cylindrically shaped connecting member to magnetically couple with said magnetizable body.

4. The geometric construction toy recited in claim 3 wherein said magnetizable body is cube shaped.

5. The geometric construction toy recited in claim 4 where said geometric construction toy further comprises an outer body made of an insulative material and where said outer body is spherically shaped and surrounds at least in part said magnetizable body and where said outer body contains a multiplicity of apertures where each said aperture is concentric with one of said multiplicity of recesses respectively.

6. The geometric construction toy recited in claim 3 where said magnetizable body is spherically shaped.

7. The geometric construction toy recited in claim 6 where said geometric construction toy further comprises an outer body made of an insulative material and where said outer body is spherically shaped and surrounds at least in part said magnetizable body and where said outer body contains a multiplicity of apertures where each said aperture is concentric with one of said multiplicity of recesses respectively.

8. The geometric construction toy recited in claim 7 wherein said multiplicity of aperture are so dimensioned and proportioned to receive either said first end of said cylindrically shaped connecting member or said second end of said cylindrically shaped connecting member so as to permit said cylindrically shaped connecting member to magnetically couple with said magnetizable body.

9. A geometric construction toy, comprising:

(a) a cylindrically shaped connecting member having a first end, a second end, and an axis of elongation, where said cylindrically shaped connecting member is radially symmetrical with respect to said axis of elongation, said cylindrically shaped connecting member further comprising a first magnet captively carried within said cylindrically shaped connecting member adjacent said first end;

(b) a magnetizable body having mutually perpendicular vertical, horizontal, and lateral axes formed by the intersection of three mutually perpendicular planes, said axes having an origin point of common intersection within said magnetizable body, where said origin point of common intersection is at the geometrical center of said magnetizable body, said magnetizable body having a peripheral boundary surface symmetrical with respect to each said mutually perpendicular plane, (c) an outer body made of an insulative material where said outer body surrounds said peripheral boundary surface and has a multiplicity of apertures where each said aperature is concentric respectively with one of said axes and so dimensioned and proportioned to receive said first end of said connecting member so as to permit said cylindrically shaped connecting member to magnetically couple with said magnetizable body.

10. The geometric construction toy recited in claim 9 wherein said connecting member further comprises a second magnet captively carried within said connecting member adjacent said second end where said second end is so constructed and proportioned to captively hold said second magnet in fixed relationship within said connecting member and where said first and second ends are tapered.

11. A geometric construction toy, comprising:

(a) a connecting member having a first end, a second end, and an axis of elongation;

(b) a first magnet captively carried within said connecting member adjacent said first end where said first end is tapered and so constructed and proportioned to captively hold said first magnet in fixed relationship within said connecting member, said geometric toy further comprising a magnetizable body and an outer body surrounding at least in part said magnetizable body, said magnetizable body having mutually perpendicular vertical, horizontal, and lateral axes, formed by the intersection of three mutually perpendicular planes, said axes having a point of common common intersection at the geometrical center of said magnetizable body, where said outer body has a multiplicity of apertures so dimensioned and proportioned to receive said first end of said connecting member so as to permit said connecting member to magnetically couple with said magnetizable body.

12. The geometric construction toy recited in claim 11 wherein said connecting member further comprises a second magnet captively carried within said connecting member adjacent said second end where said second end is so constructed and proportioned to captively hold said second magnet in fixed relationship within said connecting member and where said first and second ends are tapered.

* * * * *